US006305082B1

(12) United States Patent
Troncoso

(10) Patent No.: US 6,305,082 B1
(45) Date of Patent: Oct. 23, 2001

(54) FLUSH OUT CLEANABLE RAZOR

(76) Inventor: Vincent F. Troncoso, 1665 Hermosa Ct., Montrose, CO (US) 81401

( * ) Notice: Subject to any disclaimer, the term of this patent is extended or adjusted under 35 U.S.C. 154(b) by 0 days.

(21) Appl. No.: 09/666,824

(22) Filed: Sep. 21, 2000

Related U.S. Application Data

(63) Continuation of application No. 09/336,395, filed on Jun. 18, 1999, now abandoned.

(51) Int. Cl.[7] ..... B26B 21/40
(52) U.S. Cl. ..... 30/41.5; 30/41
(58) Field of Search ..... 30/41.5, 41, 50, 30/47, 34.05, 535, 541

(56) References Cited

U.S. PATENT DOCUMENTS

| | | |
|---|---|---|
| D. 270,383 | 8/1983 | Gray . |
| D. 271,625 | 11/1983 | Gray . |
| D. 294,528 | 3/1988 | Gray . |
| D. 296,247 | 6/1988 | Gray . |
| 3,935,639 | 2/1976 | Terry et al. . |
| 4,047,296 | 9/1977 | Ishida et al. . |
| 4,170,821 | 10/1979 | Booth . |
| 4,200,976 | 5/1980 | Gooding . |
| 4,205,437 | 6/1980 | Chen et al. . |
| 4,205,441 | 6/1980 | Turner . |
| 4,344,227 | 8/1982 | Chen et al. . |
| 4,354,312 | 10/1982 | Trotta . |
| 4,403,413 | 9/1983 | Trotta . |
| 4,407,067 | 10/1983 | Trotta . |
| 4,411,065 | 10/1983 | Trotta . |
| 4,422,237 | 12/1983 | Trotta . |
| 4,486,952 | 12/1984 | Trotta . |
| 4,709,476 | 12/1987 | Shurtleff et al. . |
| 4,785,534 | 11/1988 | Lazarchik . |
| 4,807,401 | 2/1989 | Atwater . |
| 4,916,817 | 4/1990 | Atwater . |
| 5,177,870 | 1/1993 | Jursich et al. . |
| 5,265,337 | 11/1993 | Lowder . |

*Primary Examiner*—Douglas D. Watts
(74) *Attorney, Agent, or Firm*—Rider, Bennett, Egan & Arundel

(57) ABSTRACT

A flush out razor cleanable by water includes a handle with a water inlet port. A manifold is provided connected to the handle opposite from and in flow communication with the water inlet port. The manifold has a water outlet. A blade cartridge is preferably sealably located at the manifold outlet wherein the cartridge supports at least one razor blade. The cartridge has water flush out ports in flow communication with the manifold adjacent above and below the blade to flush out and clean the razor with water passing through the handle.

22 Claims, 3 Drawing Sheets

FLUSH OUT CLEANABLE RAZOR

This application is a continuation of patent application Ser. No. 09/336,395, filed Jun. 18, 1999 now abandoned.

BACKGROUND OF THE INVENTION

This invention relates to wet shaving razors, and more particularly to a razor that permits clean-out of the blade cartridge by way of faucet water passing into the handle inlet, through the handle and manifold and out the water flush-out ports above, below and adjacent the razor blade or blades in the cartridge.

Wet shaving razors are utilized by both men and women in removing unwanted body hair. Typically, the razor user washes the area to be shaved and then applies a beard or hair softening foam or gel. After which, the razor with its shaving blades is dragged over the body surface to cut off the unwanted hair or beard at the skin surface.

Early razors were characterized as having a blade pivotally mounted to the handle and the handle being adapted to receive the razor blade portion when not in use. Next, razors were devised to be a single unit with an openable head adapted to receive and support a double edge razor blade that could be disposed of upon the dulling of the blade and replaced with a new double edge razor blade.

Next, razors were made of molded plastic having an integral handle connected to a razor cartridge or head supporting one or more razor blades. Subsequently, the handles were designed to be more ergonomic and to support detachable razor cartridges. Upon a dulling or clogging up of the razor cartridge, the user simply ejected the cartridge from the handle and put on a new razor cartridge with sharp and clean blades.

The next significant razor improvement included making the blade cartridge pivotally mountable to the handle to permit the cartridge to follow the contours of the face or skin. Overcaps or shields were also developed for razors to protect the blade and to insure that one would not easily cut oneself when reaching within a tote or shaving kit bag having the razor therein. Water soluble shaving aids were also placed on the cap portion of the razor cartridge which provided for a lubricant, softener, medicinal agent and cosmetic agent as shown in U.S. Pat. No. 4,170,821 issued to Booth on Oct. 16, 1979.

Razor blade cartridges generally consisted of a platform portion supporting a first razor blade with a spacer thereupon and a second razor blade upon the spacer, all of which are held in place by a cap. Razor blade cartridges are press fit together, as well as by other mechanical, adhesive or heat bonding techniques, which are known in the prior art. These inexpensive and easy assembly techniques have made razors and razor blade cartridges readily disposable.

The single, most disconcerting problem with razor blade cartridges is that they tend to clog with the freshly cut foamed hair or beard, rendering the cartridge somewhat inoperable in that one can no longer get a clean shave or a clean presentation of the razor blades upon the skin.

Thus, spacers were made that could be moved from the retracted position relative to the blades to an advanced ejecting position forcing out hair and soap from between the blades. Examples of this technology are shown in U.S. Pat. No. 4,047,296 issued to Ishida on Sep. 13, 1977; U.S. Pat. No. 4,205,437 issued to Chen on Jun. 3, 1980; and U.S. Pat. No. 4,344,277 issued to Chen on Aug. 17, 1982. While the anti-clogging feature of the spacer tended to generally work, it did not completely clean the razor cartridge, especially above and below and adjacent the razor blades within the cartridge to insure optimum subsequent usage of the razor.

The Gillette Company of Boston, Mass. has subsequently developed two razors called the Sensor® and the Mach III®. These razors attempt to present open spaces between the blades for cleaning. However, these designs do not permit thorough flushing out of the razor cartridge and require that water be flushed through the cartridge from multiple angles because the blades are L-shaped in cross section likely for strength.

There is a need for a simple flush out cleanable razor that will permit the user to simply flush cut hairs, soap and beard particles out of the razor cartridge and in and around the razor blades, to insure a smooth clean shave with the next stroke. Such a flush out cleanable razor should be easily flushed out from a single easy to locate inlet port.

SUMMARY OF THE INVENTION

A flush out razor cleanable by water includes a handle with a water inlet port. A manifold is provided connected to the handle opposite from and in flow communication with the water inlet port. The manifold has a water outlet. A blade cartridge is preferably sealably located at the manifold outlet wherein the cartridge supports at least one razor blade. The cartridge has water flush out ports in flow communication with the manifold adjacent above and below the blade to flush out and clean the razor with water passing through the handle.

A principal object and advantage of the present invention is that the razor blades and cartridge are easily cleanable by water flushing out through flush out ports adjacent above and below the one or more blades of the razor.

Another object and advantage of the present invention is its simple and inexpensive construction while yet presenting a razor that is easily cleaned and flushed out without complicated moving parts.

Another object and advantage of the present invention is that water merely has to be directed into the handle inlet port which will permit the water to flush out the razor blade cartridge through the water flush out ports to remove soap, debris and hair particles from the razor, without the need of flushing the razor cartridge from multiple angles.

Another object and advantage of the present invention is that the handle and manifold are of a single piece integral design making it readily effective for flushing out the razor blade cartridge without complicated molding or expensive mechanical parts.

Another object and advantage of the present invention is that the handle and a water inlet portion may be enlarged to increase velocity and pressure of the water passing through the razor to clean out the cartridge head.

Another object and advantage of the present invention is that the razor may be readily adapted to receive a pivoting insertable cartridge with at least one razor blade.

Another object and advantage of the present invention is that the water inlet port in the end of the handle can be easily and readily positioned at the sink spout without visual aid.

Other objects and advantages of the present invention will become readily apparent upon a reading of the specification, claims and appended drawings.

DETAILED SPECIFICATION

Figure 7:
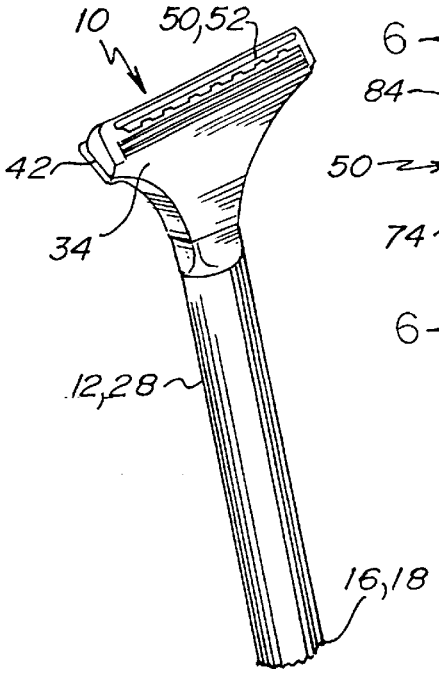
FIG. 7 is a front perspective view of the razor of the present invention.

Referring to FIGS. 1 through 7, the flush out cleanable razor 10 of the present invention may be appreciated. Generally, the razor 10 includes handle 12 with water inlet port 18 at the handle end 16. The manifold 34 is integral with the opposite end of the handle 12 which supports a blade cartridge 50 with one or more blades 90 or 94. Water flush out ports 60, 76 and 84 are above, below and adjacent blades 90 and 94.

More specifically, handle 12 is suitably hollow having a hollow portion or conduit portion 14 extending from the handle end 16 whereat is located water inlet port 18 and extending towards manifold 34 in the opposite direction. Flared handle end 20 may be provided with an enlarged water inlet port 22 creating an enlarged surface area $A_l$ compared to smaller surface area $A_s$ located at the opposite end of the handle 12. Most sink spouts 24 on faucets 26 have a diameter of approximately ¾". Thus, the enlarged water inlet port 22 will permit increased water velocity and pressure through the razor 10 for cleaning. For example, with the same amount of water passing through the razor, the large area ($A_l$) has a slower velocity ($V_s$) at the handle end 16 or 22, while at the smaller area portion ($A_s$) has a higher velocity ($V_h$) pursuant to $V_sA_l=V_hA_s$. Similarly, there is an increased higher pressure ($P_h$) at the smaller area portion ($A_s$) than at the larger area portion ($A_l$) pursuant to $P_lA_l=P_hA_s$.

By these fluid formulas and construction of the handle 12, it can be appreciated that water coming from the sink spout 24 into flared handle end 20 with enlarged surface area $A_l$ water will increase in velocity and pressure as it passes through the hollow conduit 14 of handle 12 as it reaches the smaller surface area $A_s$ at the manifold 34 where velocity and pressure will be substantially increased to clean out the cleanable razor 10.

Opposite the water inlet 18 or 20 is manifold 34 which preferably may be integral or molded with the handle 12. Manifold 34 is also hollow and has a manifold flared outwardly portion 36 with an outlet 38. At the outlet 38 is located the cartridge housing 44 with side walls 42 for generally supporting a blade cartridge 50.

Blade cartridge 50 suitably has a face 72 which engages the skin of the user. Cartridge 50 includes a cap portion 54 which may or may not support a shaving aid 56 as previously disclosed. Cap portion 54 has fingers 58 with water flush out port 60 between the fingers 58. The cap portion 54 has lug engaging slot 62 and blade insertion bevel 64. Blade platform or support base 66 is below the cap portion 54 and suitably has a guard portion 68 and hair lifting or beard lifting ridges 70. Platform 66 also has blade insertion bevel 72 and blade support rib 74 with water flush out port 76 between the support ribs 74. Platform 66 also has lug engaging slots 78.

Figure 4:
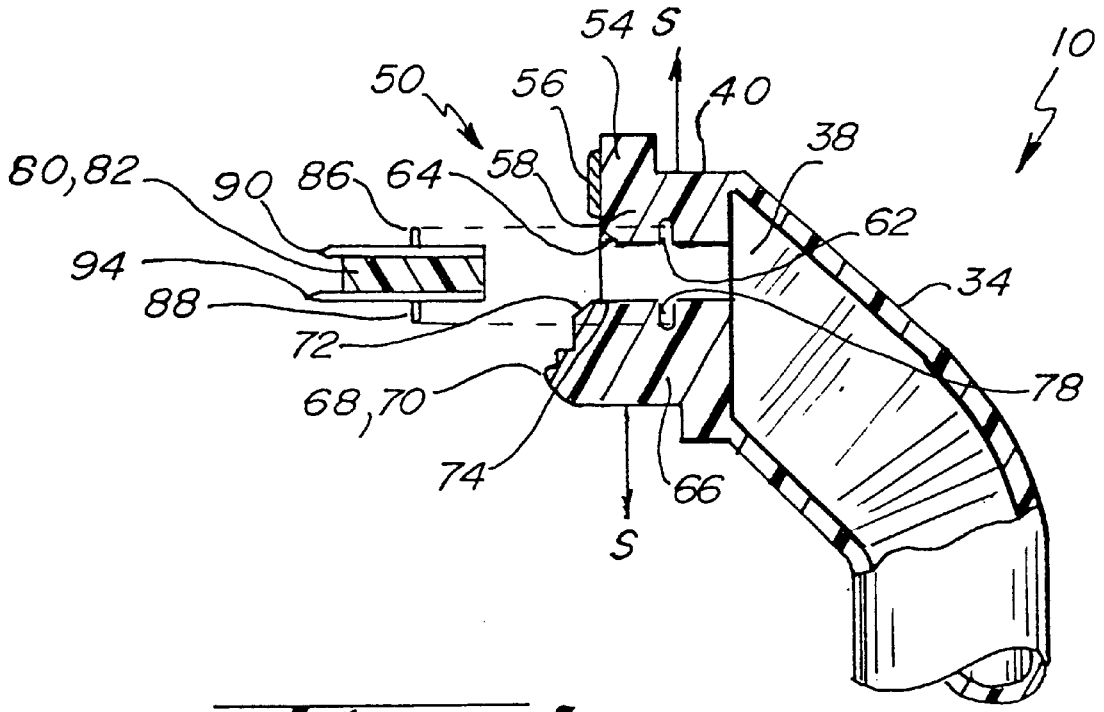
FIG. 4 is similar to FIG. 2 with portions of the blade cartridge being aligned for insertion into the razor cartridge.

Blade cartridge 50 also includes cartridge blade spacer 80 shown just before insertion into the blade cartridge 50 in FIG. 4. The blade spacer 80 includes blade retaining ribs 82 with water flush out ports 84 between the ribs 82. Upper lugs 86 and lower lugs 88 are engageable and lockable within lug engaging slots 62 and 78 of the cap portion 54 and platform 66, respectively, as the cartridge 50 springs outwardly as shown (arrow S) to receive cartridge blade spacer 80 for a press fit.

Cartridge blade spacer 80 includes blade retaining ribs 82 with water flush out ports 84 therebetween. The blade spacer 80 includes upper lugs 86 and lower lugs 88. Upon the ribs 82 is located upper blade 90 which suitably has indexing slots (not shown) for indexing the blade 90 upon upper lugs 86. Lower blade 94 similarly has indexing slots (not shown) for indexing upon the lower lugs 88. As the blade spacer 80, with blades 90 and 94, engage the blade insertion bevels 64 and 72, the cartridge 50 expands shown by opposing arrows S until the blade spacer 80 has its lugs 86 and 88 engaged into slots 62 and 78.

By this arrangement, the user may begin wet shaving and periodically tip the razor 10 upside down and locate the handle end 16 at the sink spout 24. As the water W passes from the faucet 26, the water $W_1$ goes into the handle conduit 14. From the handle conduit 14, the water passes into the manifold and then is directed through flush out ports 60, 76 and 84 shown as arrows $W_2$, $W_3$ and $W_4$. By this arrangement, all areas adjacent above and below the upper blade 90 and lower blade 94 are thoroughly flushed to clean the blade cartridge 50 and make the blade cartridge 50 free of dirt, soap, hair and debris ready for the next clean and smooth shaving stroke.

Figure 6:
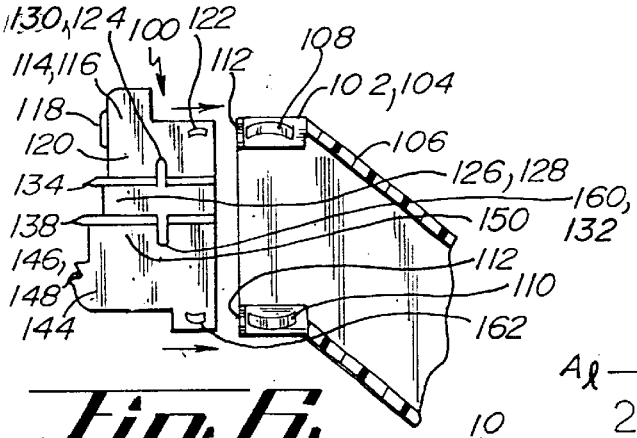
FIG. 6 is a figure similar to FIG. 4 taken along lines 6—6 of FIG. 1 showing a rotatable insertable blade cartridge aligned with the manifold of the razor.
Figure 1:
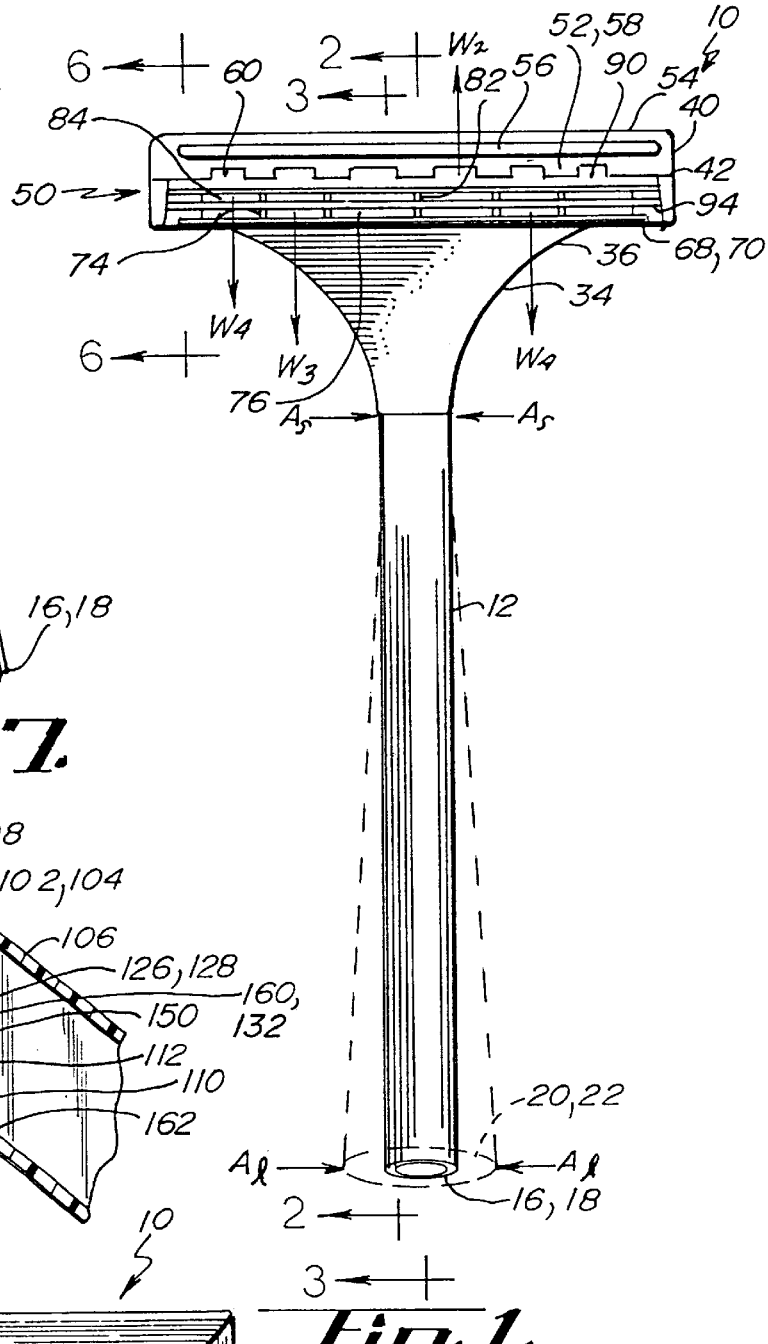
FIG. 1 is a front elevational view of the flush out cleanable razor.
Figure 5:
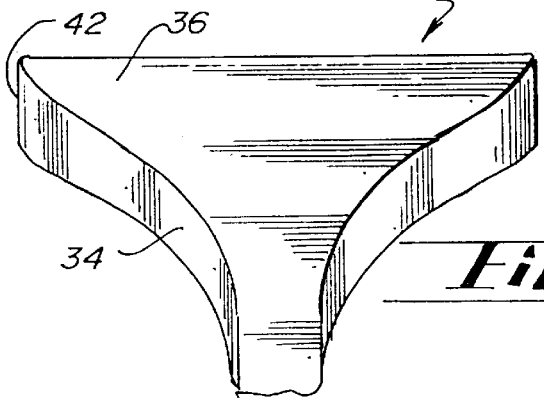
FIG. 5 is a rear elevational view of the razor blade with the handle broken away showing the enclosed manifold.
Figure 2:
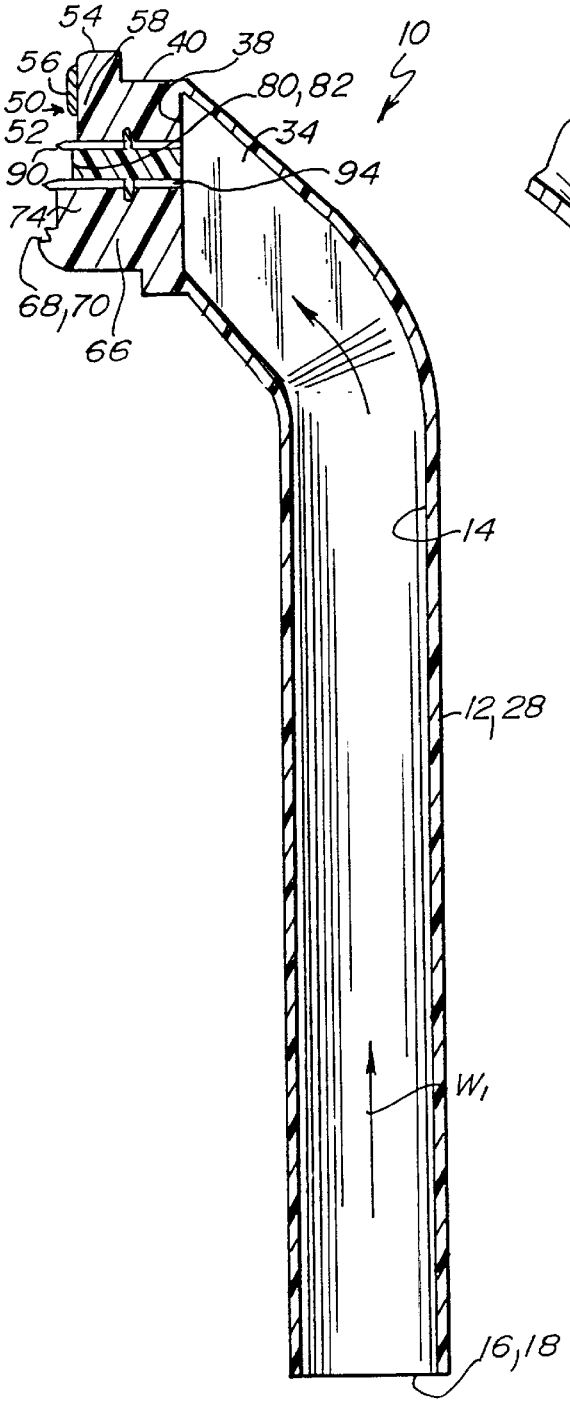
FIG. 2 is a cross-sectional view taken along lines 2—2 of FIG. 1.
Figure 3:
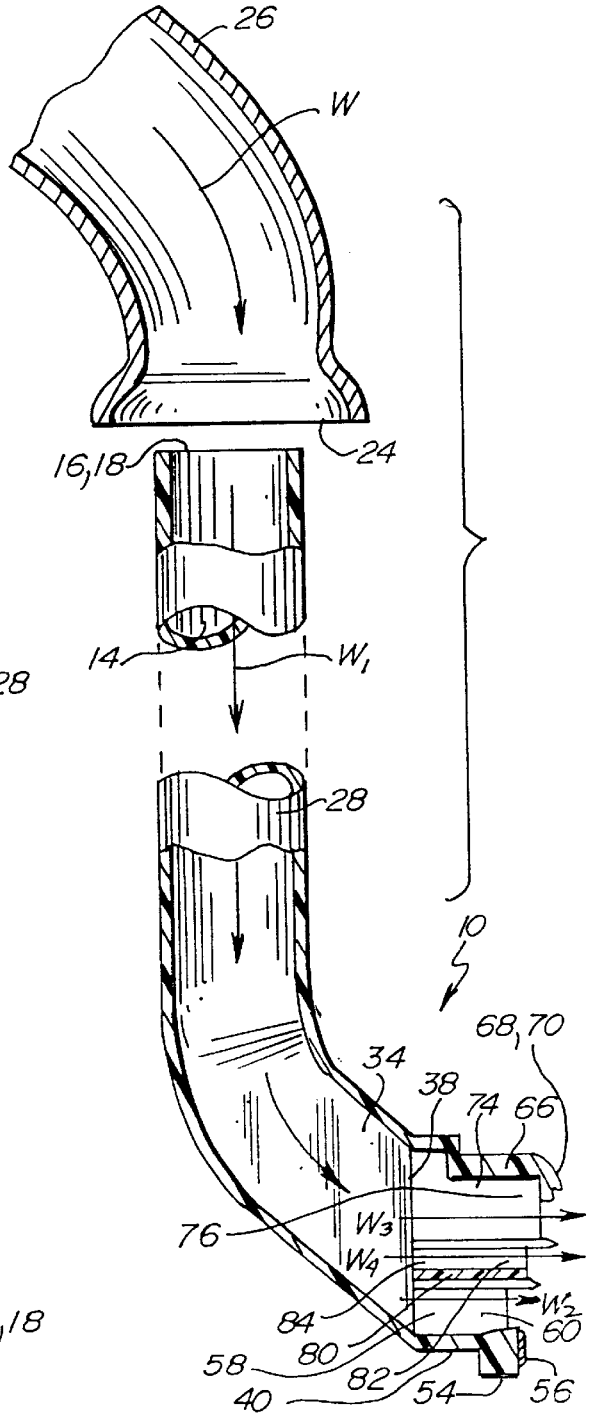
FIG. 3 is a cross-sectional partially broken away view of the razor taken along lines 3—3 of FIG. 1 showing the razor in inverted flush out position at a water faucet.

Referring to FIG. 6, a pivoting insertable cartridge 100 is shown. Manifold housing 102 has side walls 104 with a manifold 106 similar to manifold 34. In the side walls 104 are located the upper arcuate cartridge retaining slots that are elongate and lower arcuate and elongate cartridge retaining slots 110. Cartridge insertion bevels 112 may also be provided to aid in the insertion of blade cartridge 114 as side walls 104 temporarily expand laterally or outwardly.

Blade cartridge 114 has a cap portion with a shaving aid 118 and fingers 120. Upper cartridge retaining lugs 122 may be arcuate to fit within the upper retaining slots 108 while the cap portion also has a spacer lug retaining slot 124. The blade spacer 126 has blade retaining ribs 128 with upper and lower lugs 130 and 132, respectively. An upper blade 134 indexes upon the upper lugs 130, while a lower blade 138 similarly indexes upon lower lugs 132.

The platform or support base 144 includes a guard portion 146 and hair lifting ridges 148. Blade support ribs 150 are provided and spacer lug retaining slots 160. Also are provided the lower cartridge retaining lugs 162. 108 and 110 to permit the cartridge 100 to pivot or rotate to conform to the contours of the face or skin of the user. This construction similarly has the water flush out ports above, below and adjacent the upper and lower blades 134 and 136.

It can be appreciated that a third blade would be possible with the water flush out razor 10 if so desired. If water were not available to flush out the razor, the user may actually blow into the handle inlet port 18 to blow out hair particles, soap and debris without the aid of pressurized water.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed:

1. A flush out razor cleanable by water, comprising:

(a) a handle having a first end and a second end and an interior diameter with a water inlet port at the first end;

(b) a closed manifold at the second end connected to the handle and in flow communication with the inlet port, the manifold having a water outlet;

(c) a blade cartridge located at the manifold outlet, the cartridge supporting at least one razor blade with water flush out ports adjacent the blade to flush out and clean the razor with water from the handle; and (d) wherein the interior diameter of the handle at the first end is equal to or greater than the interior diameter of the handle at the second end.

2. The razor of claim 1, wherein at least a portion of the handle from the inlet port to the manifold is hollow.

3. The razor of claim 1, wherein the manifold from the handle flares outwardly to sealably support the blade cartridge.

4. The razor of claim 1, wherein the blade cartridge has side walls with a blade platform therebetween supporting a razor blade upon ribs with water flush out ports between the ribs and a cap portion above with downward fingers holding the razor blade upon the platform with more water flush out ports between the fingers.

5. The razor of claim 4, further comprising a blade spacer between the cap portion and the first blade and the platform with blade retaining ribs supporting a second blade thereupon with more water flush out ports between the retaining ribs.

6. The razor of claim 1, wherein the blade cartridge is pivotable at the manifold outlet.

7. The razor of claim 1, wherein the water flush out ports are above and below the blade to permit cleaning of the blade with water from the faucet.

8. The razor of claim 1, wherein the handle is hollow from the inlet port located at a handle end remote from the manifold.

9. The razor of claim 8, wherein the handle approaching the water inlet port increases in diameter to allow more water into the handle.

10. The razor of claim 1, wherein the cartridge is sealably inserted into the manifold outlet.

11. A flush out razor cleanable by pressurized water from a faucet, comprising:

(a) a handle having a first end and a second data with at least a portion being hollow with a water inlet port at the first end;

(b) a closed manifold connected to the handle at the second end and in flow communication with the hollow portion of the handle having a flared outwardly portion with a water outlet thereat; and (c) a blade cartridge sealably located at the manifold outlet supporting at least one razor blade with water flush out ports above and below the blade to flush out and clean the razor with water from the faucet.

12. The razor of claim 11, wherein the blade cartridge has side walls with a blade platform therebetween supporting a razor blade upon ribs with water flush out ports between the ribs and a cap portion above with downward fingers holding the razor blade upon the platform with more water flush out ports between the fingers.

13. The razor of claim 11, further comprising a blade spacer between the cap portion and the first blade and the platform with blade retaining ribs supporting a second blade thereupon with more water flush out ports between the retaining ribs.

14. The razor of claim 11, wherein the blade cartridge is pivotable at the manifold outlet.

15. The razor of claim 11, wherein the handle is hollow from the inlet port located at a handle end remote from the manifold.

16. The razor of claim 15, wherein the handle approaching the water inlet port increases in diameter to allow more water into the handle.

17. The razor of claim 11, wherein the cartridge is sealably inserted into the manifold outlet.

18. A flush out razor cleanable by pressurized water from a faucet, comprising:

(a) a hollow handle having a first end and a second end with a water inlet port at the first end;

(b) a closed manifold connected to the handle at the second end opposite the water inlet port in flow communication with the inlet port and the hollow portion, the manifold having a flared outwardly portion with a water outlet thereat; and (c) a blade cartridge sealably inserted into the manifold outlet supporting at least one razor blade with water flush out ports above and below the blade to flush out and clean the razor above and below the blade with pressurized water from the faucet.

19. The razor of claim 18, wherein the blade cartridge has side walls with a blade platform therebetween supporting a razor blade upon ribs with water flush out ports between the ribs and a cap portion above with downward fingers holding the razor blade upon the platform with more water flush out ports between the fingers.

20. The razor of claim 18, further comprising a blade spacer between the cap portion and the first blade and the platform with blade retaining ribs supporting a second blade thereupon with more water flush out ports between the retaining ribs.

21. The razor of claim 18, wherein the blade cartridge is pivotable at the manifold outlet.

22. The razor of claim 18, wherein the handle approaching the water inlet port increases in diameter to allow more water into the handle.

* * * * *

UNITED STATES PATENT AND TRADEMARK OFFICE

CERTIFICATE OF CORRECTION

PATENT NO. : 6,305,082 B1
DATED : October 23, 2001
INVENTOR(S) : Vincent F. Troncoso It is certified that error appears in the above-identified patent and that said Letters Patent is hereby corrected as shown below:

Column 5,
Line 56 cancel "data" and substitute therefor -- end --.

Signed and Sealed this

Twenty-eighth Day of May, 2002

*Attest:*

*Attesting Officer*

JAMES E. ROGAN
*Director of the United States Patent and Trademark Office*